US007890681B2

(12) United States Patent
Yung-Chang

(10) Patent No.: US 7,890,681 B2
(45) Date of Patent: Feb. 15, 2011

(54) MOBILE DEVICE AND METHOD FOR GENERATING ACTION PLAN

(75) Inventor: Liang Yung-Chang, Taipei (TW)

(73) Assignee: Qisda Corporation, Taoyuan County (TW)

( * ) Notice: Subject to any disclaimer, the term of this patent is extended or adjusted under 35 U.S.C. 154(b) by 150 days.

(21) Appl. No.: 12/134,794

(22) Filed: Jun. 6, 2008

(65) Prior Publication Data

US 2008/0305933 A1 Dec. 11, 2008

(30) Foreign Application Priority Data

Jun. 8, 2007 (TW) ..... 96120734 A

(51) Int. Cl.
*G06F 13/12* (2006.01)
*G06F 3/00* (2006.01)
*A63B 71/00* (2006.01)

(52) U.S. Cl. ..... 710/72; 710/18; 710/19; 710/73; 482/8; 482/9

(58) Field of Classification Search ..... None
See application file for complete search history.

(56) References Cited

U.S. PATENT DOCUMENTS

2005/0070809 A1* 3/2005 Acres ..... 600/508
2008/0004904 A1* 1/2008 Tran ..... 705/2

* cited by examiner

*Primary Examiner*—Alan Chen

(57) ABSTRACT

The present invention related to a mobile device and, more specifically, to a mobile device for communicating with an electronic device and a method for generating an action plan via the mobile device.

18 Claims, 3 Drawing Sheets

MOBILE DEVICE AND METHOD FOR GENERATING ACTION PLAN

BACKGROUND OF THE INVENTION

1. Field of the Invention

The invention relates to a mobile device and, more specifically, to a mobile device for communicating with an electronic device and a method for generating an action plan via the mobile device.

2. Description of the Prior Art

In recent years, the concept of body-building by exercising has been becoming popular gradually. However, in present busy society, people always do not have enough time to exercise due to study and work. Thus, more and more gymnasiums emphasizing convenience and comfort are established, and all kinds of exercising facilities are launched to the market to provide various options to consumers.

However, when a user wants to exercise by using the exercising facility, he/she will probably feel confused about the exercising effects provided by different exercising facilities. And, because everyone's physical condition is different, many settings are needed to be inputted manually; thus, the exercising effects provided by the exercising facilities will be changed. The above-mentioned factors will lower the user's interests to these exercising facilities. In addition, after a user exercises by using the exercising facility, the exercising contents will not be recorded in detail to be a reference for future exercise. Since the exercising facility itself will not provide the most suitable personalized exercising plan according to the user's state of physiology and requirement, the only way for the user to do is to decide the exercising contents of using the exercising facility based on his subjective impression.

In another example, when a user plays a video game via a public game machine, the user's information like the personal game setting value and the preferred joystick setting must be inputted again. It is inconvenient for the user. Moreover, after the user finishes the game by using other's electronic game machine, the game results obtained in that game history will not be saved in the game machine for the use of next time.

In order to solve the above problems, the invention provides a mobile device for communicating with an electronic device and a method of generating an action plan via the mobile device.

SUMMARY OF THE INVENTION

An embodiment according to the invention is a mobile device for communicating with an electronic device, for example a game machine, an exercising apparatus or a vending machine. A reference parameter is stored in the electronic device. The mobile device includes a storing module, a receiving module, and a planning module. The storing module therein stores user data related to a user. The receiving module is used for receiving the reference parameter from the electronic device. The planning module is electrically connected to the storing module and the receiving module and used for generating an action plan according to the user data and the reference parameter. Namely, after the electronic device is used by the user, a used parameter is generated by the electronic device and transmitted to the receiving module. Then, the action plan is updated by the planning module according to the used parameter.

The advantage and spirit of the invention may be understood by the following recitations together with the appended drawings.

BRIEF DESCRIPTION OF THE APPENDED DRAWINGS

DETAILED DESCRIPTION OF THE INVENTION

The scope of the invention is related to a mobile device and, more specifically, to a mobile device for communicating with an electronic device.

Figure 1:
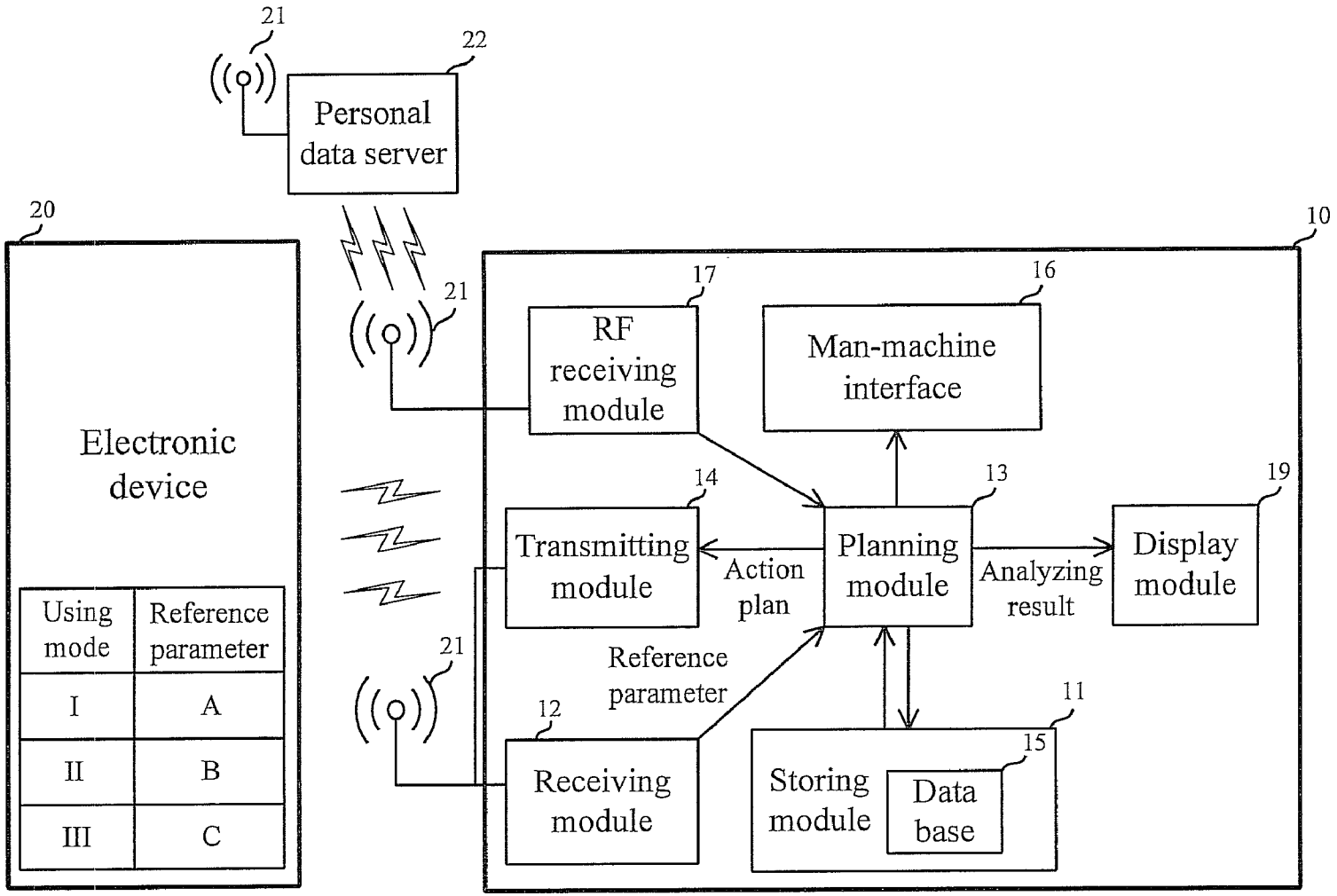
FIG. 1 shows a functional block diagram of the mobile device for communicating with an electronic device in the first embodiment according to the invention.

According to the invention, the first embodiment is a mobile device for communicating with an electronic device. Please refer to FIG. 1. FIG. 1 shows a functional block diagram of the mobile device for communicating with an electronic device in the first embodiment according to the invention. As shown in FIG. 1, the mobile device 10 includes a storing module 11, a receiving module 12, and a planning module 13. The storing module 11 therein stores user data related to a user, and the user data can be downloaded from a personal data server 22 in a wireless or wired way.

The receiving module 12 is used for receiving a reference parameter from an electronic device 20. The planning module 13 is electrically connected to the storing module 11 and the receiving module 12 and used for generating an action plan according to the user data and the reference parameter. The action plan contains information for how or when to use the electronic device 20. After the user uses the electronic device 20, the electronic device 20 will generate a used parameter and transmit the used parameter to the receiving module 12. In fact, the used parameter can be the time that the user used the electronic device 20 or a using result. The action plan is updated by the planning module 13 according to the used parameter.

After the reference parameter is received by the receiving module 12, the reference parameter can be stored in the storing module 11. Assume that the electronic device 20 has a plurality of using modes. When the user selects one of the using modes of the electronic device 20, the planning module 13 can modify the reference parameter and update the reference parameter stored in the storing module 11.

For example, if the above-mentioned electronic device 20 is an exercising apparatus, then the user data stored in the storing module 11 can be an age, a height, a weight, an average heartbeat frequency, an average blood pressure value, or a history of the user. If the electronic device 20 is an electronic game machine, the user data can be a previous game record played by the user, a personal data setting, or purchased game points. The user can set the user data in the mobile device 10 and the user data will be stored in the storing module 11. The user can download the user data through internet by using the wired or wireless communication, or set the user data through a man-machine interface 16 of the mobile device 10.

In addition, the reference parameter can be a setting or data related to the electronic device 20. For example, assume that the electronic device 20 is a multi-function exercising apparatus; the reference parameter can be a parameter that shows the calorific capacity consumed by the user when he uses the running function of the multi-function exercising apparatus to run 1 kilometer in a specific rate. Therefore, when the total calorific capacity the user should consume per day is obtained from the user data, the planning module 13 can suggest the user the suggested total kilometers or total time he should run per day.

For example, the electronic device 20 can be respectively built in all kinds of the exercising apparatus (e.g., a running apparatus, a mountaining apparatus) in the gymnasium. As the electronic device 20 shown in FIG. 1, every exercising apparatus can save the reference parameters corresponding to different using modes in advance. For example, the reference parameter corresponding to a running function (using mode I) is A (12 calories/kilogram/hour); the reference parameter corresponding to a mountaining function (using mode II) is B (10 calories/kilogram/hour). When a user brings the mobile device 10 into the gymnasium, the mobile device 10 can search the exercising apparatuses in the gymnasium and receive these reference parameters via the receiving module 12 (e.g., a bluetooth module).

At this time, the planning module 13 can set an action plan according to these parameters and the user data. If the user data includes the weight of the user (88 kilograms), the maximum exercising time per day (40 minutes), and the calorie capacity should be consumed by the user (600 calories), the action plan planned by the planning module 13 for the user would be using the running apparatus for 16 minutes and the mountaining apparatus for 21 minutes to reach the exercising amount of consuming 600 calories. These data can be transmitted to the user through the display module 19 via the mobile device 10.

According to the above-mentioned example, after the user uses the running apparatus for 21 minutes, the running apparatus will transmit the used time to the mobile device 10. At this time, the planning module 13 will plan a new action plan again, such as "continuing using the mountaining apparatus for 16.5 minutes to reach the today's expected consumed calorie capacity". The action plan is not limited to a one-day plan, and different calculating rules can be set for the today's unfinished plan or exceeding progress to make the planning module 13 calculate a suitable action plan.

In practical applications, the mobile device 10 can be a mobile phone or a PDA. In addition, the action plan can include not only a suggested time for the user using the electronic device 20, but also a plurality of mode options related to the electronic device 20 and a plurality of using time corresponding to the mode options.

As shown in FIG. 1, the mobile device 10 can further include a transmitting module 14 and a database 15. The transmitting module 14 is electrically connected to the planning module 13 and used for transmitting the action plan to the electronic device 20. The database 15 is stored in the storing module 11, and therein stores a plurality of default action plans. And the action plan is selected from the plurality of default action plans according to the user data and the reference parameter of the electronic device 20. In addition, the database 15 can be updated by connecting to a server through the internet. In some mobile apparatuses 10, the receiving module 12 and the transmitting module 14 can be integrated into a single receiving/transmitting module, such as a bluetooth module.

In practical applications, assume that the electronic device 20 is an exercising apparatus. Then, after the user uses the exercising apparatus, the exercising apparatus will generate an after-exercising data. The after-exercising data can include an exercising time, a heartbeat frequency, a blood pressure value, or a consumed calorie capacity of the user. Therefore, the mobile device 10 according to the invention can plan an exercising plan which is most suitable for the physical state and the exercising habit of the user through these professional exercising mode suggestions and the analyzing of the user data.

In addition, as shown in FIG. 1, the mobile device 10 can further include a display module 19. The display module 19 is electrically connected to the planning module 13. After the receiving module 12 receives the after-exercising data from the exercising apparatus, the after-exercising data is stored by the storing module 11. The planning module 13 can be used for analyzing the after-exercising data to generate an analyzing result. The display module 19 can be used for displaying the analyzing result. The analyzing result can include the using frequency of different exercising options, an exercising time, a heartbeat frequency, a blood pressure value, or a consumed calorie capacity of the user.

In fact, the mobile device 10 can further include a man-machine interface 16 and a RF receiving module 17, as shown in FIG. 1. The man-machine interface 16 is electrically connected to the planning module 13, and the user is capable of communicating with the mobile device 10 via the man-machine interface 16. Namely, the user can input data or select options via the man-machine interface 16 of the mobile device 10. The RF receiving module 17 is electrically connected to the planning module 13 and an antenna 21 of the mobile device 10, and used for receiving and transmitting a RF signal (e.g., communicating with the personal data server 22).

Figure 2:
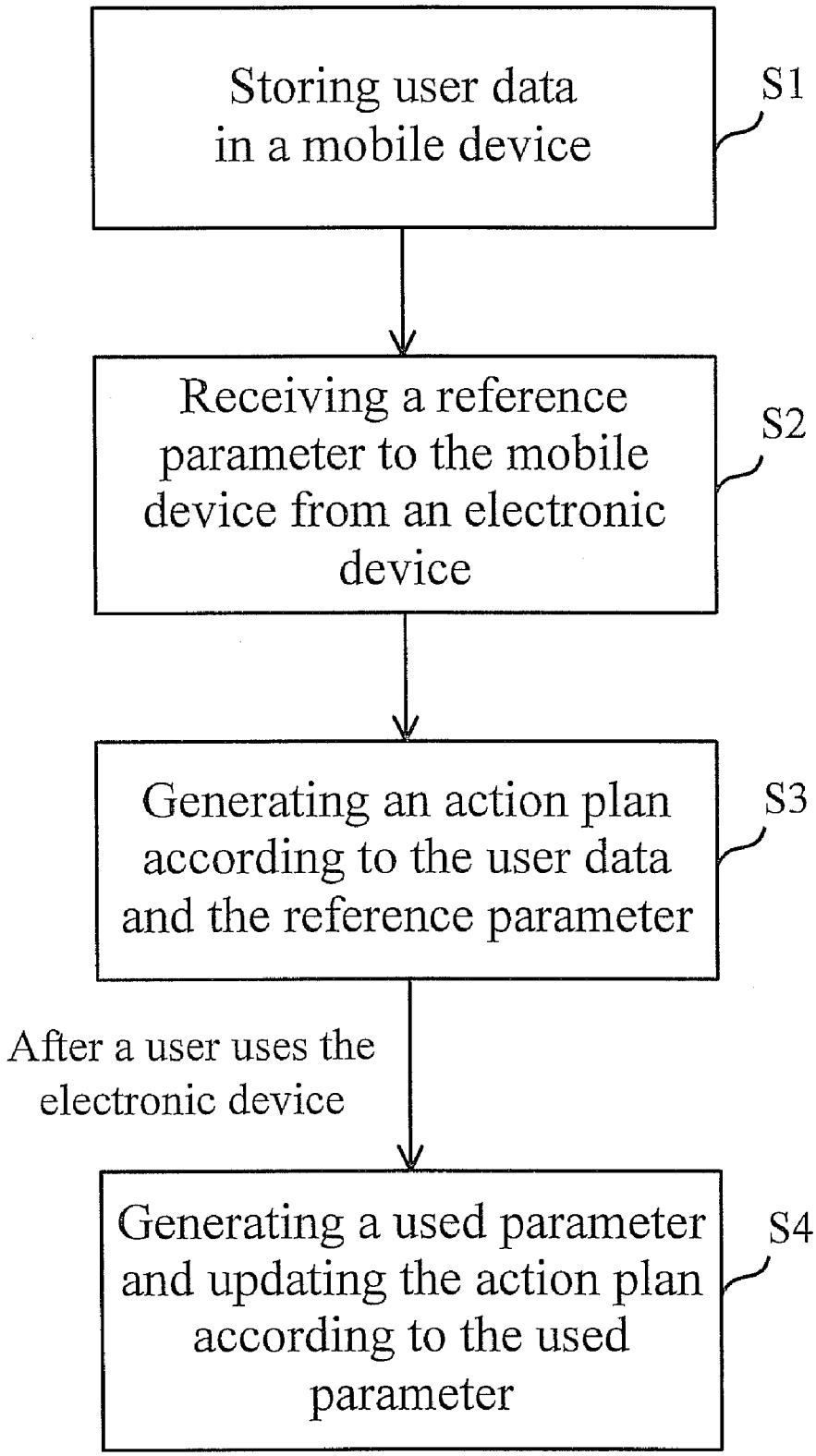
FIG. 2 shows a flowchart of the method of generating an action plan in the second embodiment according to the invention.

The second embodiment according to the invention is a method of generating an action plan applied to a mobile device. The method is suitable for a mobile device. Please refer to FIG. 2. FIG. 2 shows a flowchart of the method. At first, the method performs step S1 to store user data related to a user in the mobile device. Next, in step S2, the method receives a reference parameter to the mobile device from an electronic device. Then, the method performs step S3 to generate an action plan according to the user data and the reference parameter. After the user uses the electronic device, the method can perform step S4 to generate a used parameter and update the action plan according to the used parameter.

In this embodiment, if the electronic device has a plurality of using modes, the method can store the reference parameter in the mobile device. And, when one of the plurality of using modes of the electronic device is selected by the user, the method can modify the reference parameter and update the reference parameter stored in the mobile device. In addition, the method can also transmit the action plan from the mobile device to the electronic device. If a plurality of default action plans is stored in the mobile device, then the method selects the action plan from the plurality of default action plans according to the user data.

Figure 3:
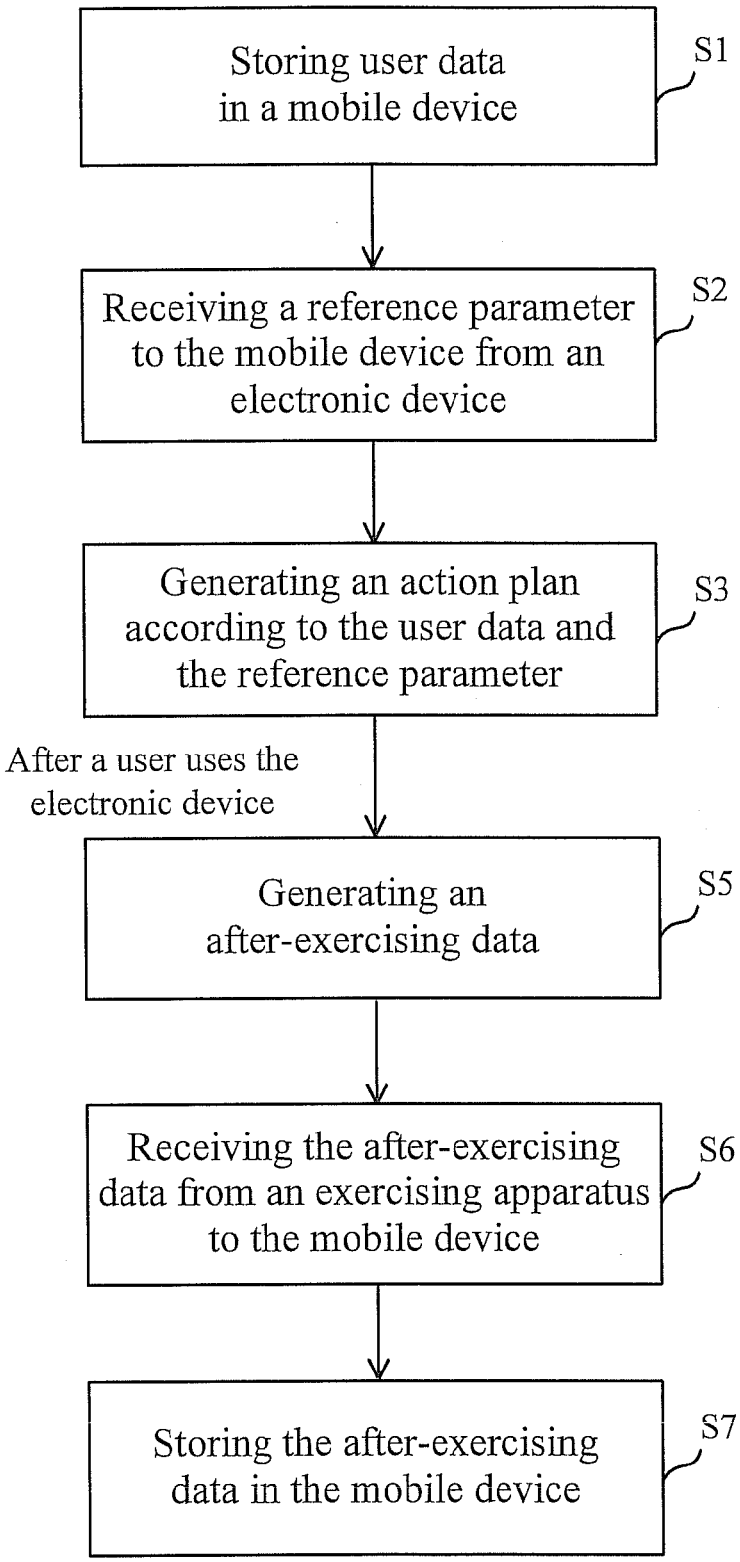
FIG. 3 shows a flowchart of the method shown in FIG. 2 further including the steps S5~S7.

In practical applications, the electronic device can be an exercising apparatus. At this time, the method of generating an action plan can include steps S5~S7, as shown in FIG. 3. After the user uses the exercising apparatus, the method can perform step S5 to generate an after-exercising data. The after-exercising data can include an exercising time, a heartbeat frequency, a blood pressure value, or a consumed calorie capacity of the user. Then, the method can perform step S6 to receive the after-exercising data from the exercising apparatus to the mobile device. Afterward, the method can perform step S7 to store the after-exercising data in the mobile device. In addition, the method can further analyze the after-exercising data to generate an analyzing result and display the analyzing result.

Compared to the prior art, the mobile device and method of generating an action plan can analyze and compare the professional exercising mode suggestion and the user data and plan a personal exercising plan which is most suitable for the user's physical state and exercising habit. In this way, the mobile device and method according to the invention can not only improve the various inconveniences and drawbacks of the prior arts, but also help the user to use the exercising apparatus by plan.

In another way, the mobile device and method provided by the invention can be also applied to the public video game machine. A video game user can store the personal game history, the personal game setting value, and the personal joystick setting value in his mobile device. Therefore, when the user use the public game machine, the personal game setting value and joystick setting value can be transmitted to the game machine through the method provided by the invention. Thus, the user can play the game according to his own setting without setting a lot of game settings again.

Furthermore, after the user finishes playing the game machine, the game results can be transmitted to the user's mobile device and stored in it through the mobile device and method provided by the invention for the convenience of the next gameplay. In addition, according to the personal game history of the user, the electronic game machine can also automatically judge the gameplay level/progress of the user to adjust the difficulty/progress to be suitable for the user.

With the above example and explanation, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A mobile device for communicating with an electronic device, comprising:

a storing module for storing a user data;

a receiving module for receiving a reference parameter from the electronic device; and a planning module, electrically connected to the storing module and the receiving module, for generating an action plan according to the user data and the reference parameter;

wherein after the electronic device is used, a used parameter is generated by the electronic device and transmitted to the receiving module, the action plan is updated by the planning module according to the used parameter.

2. The mobile device of claim 1, wherein the used parameter is a using time of the electronic device.

3. The mobile device of claim 1, wherein the mobile device searches a plurality of electronic devices, the receiving module receives the reference parameters corresponding to the electronic devices, and the planning module updates the action plan according to the reference parameters.

4. The mobile device of claim 1, wherein the user data contains at least one of an age, a height, a weight, an average heartbeat frequency, an average blood pressure value, and a history of a user.

5. The mobile device of claim 1, wherein the mobile device communicates with a first electronic device having a first reference parameter, wherein the action plan has a predetermined capacity and the updated action plan has a first used parameter corresponding to the first electronic device for consuming the predetermined capacity.

6. The mobile device of claim 5, wherein the planning module generates the updated action plan according to the user data and the first reference parameter.

7. The mobile device of claim 1, further comprising:

a transmitting module, electrically connected to the planning module, for transmitting the action plan to the electronic device.

8. The mobile device of claim 1, further comprising:

a database, stored in the storing module, storing a plurality of default action plans, the action plan being selected from the plurality of default action plans according to the user data and the reference parameter.

9. The mobile device of claim 1, wherein the electronic device is an exercising apparatus, after the user uses the exercising apparatus, the exercising apparatus generates an after-exercising data containing at least one of an exercising time, a heartbeat frequency, a blood pressure value, and a consumed calorie capacity of the user.

10. The mobile device of claim 9, further comprising:

a display module, electrically connected to the planning module, for displaying an analyzing result corresponding to the after-exercising data.

11. A method of generating an action plan applied to a mobile device, the method comprising the steps of:

storing a user data in the mobile device;

receiving a reference parameter from an electronic device to the mobile device;

generating the action plan according to the user data and the reference parameter;

generating a used parameter after using the electronic device;

receiving the used parameter from the electronic devices to the mobile device; and updating the action plan according to the used parameter.

12. The method of claim 11, further comprising the steps of:

searching a plurality of the electronic devices;

receiving the reference parameters corresponding to the electronic devices from the electronic devices; and updating the action plan according to the reference parameters.

13. The method of claim 11, wherein the user data contains at least one of an age, a height, a weight, an average heartbeat frequency, an average blood pressure value, and a history of a user.

14. The method of claim 11, wherein the action plan comprises a plurality of mode options related to the electronic device and a plurality of using time corresponding to the mode options.

15. The method of claim 11, wherein a plurality of default action plans are stored in the mobile device, the method further comprising the step of:

selecting the action plan from the plurality of default action plans according to the user data and the reference parameter.

16. The method of claim 15, wherein the mobile device updates the plurality of default action plans by connecting to a server through the internet.

17. The method of claim 11, wherein the electronic device is an exercising apparatus, the method further comprising the step of:

generating an after-exercising data after the user uses the exercising apparatus.

18. The method of claim 17, further comprising the steps of:

receiving the after-exercising data from the exercising apparatus to the mobile device; and displaying an analyzing result corresponding to after-exercising data.

* * * * *